US009281141B2

(12) United States Patent
Rochlitz et al.

(10) Patent No.: US 9,281,141 B2
(45) Date of Patent: Mar. 8, 2016

(54) MODULAR KEYBOARD ASSEMBLY

(75) Inventors: Kurt Rochlitz, Dworp (BE); Michael Walter Paul D'Hoore, Korbeekdijle (BE); Paul Joseph Claes, Tremelo (BE)

(73) Assignee: Home Control Singapore Pte. Ltd., New Tech Park (SG)

( * ) Notice: Subject to any disclaimer, the term of this patent is extended or adjusted under 35 U.S.C. 154(b) by 192 days.

(21) Appl. No.: 13/808,408

(22) PCT Filed: Jul. 6, 2011

(86) PCT No.: PCT/IB2011/052988

§ 371 (c)(1),
(2), (4) Date: Jan. 4, 2013

(87) PCT Pub. No.: WO2012/004749

PCT Pub. Date: Jan. 12, 2012

(65) Prior Publication Data

US 2013/0105292 A1 May 2, 2013

(30) Foreign Application Priority Data

Jul. 9, 2010 (EP) ..... 10169020

(51) Int. Cl.

| | |
|---|---|
| ***H01H 9/26*** | (2006.01) |
| ***H01H 13/72*** | (2006.01) |
| ***H01H 13/76*** | (2006.01) |
| ***H01H 13/705*** | (2006.01) |

(52) U.S. Cl.
CPC ..... *H01H 13/705* (2013.01); *H01H 2229/034* (2013.01); *H01H 2229/042* (2013.01)

(58) Field of Classification Search
CPC ..... H01H 13/02; H01H 13/14; H01H 13/70; H01H 13/702; H01H 13/704; H01H 13/705; H01H 13/7006; H01H 13/7013
See application file for complete search history.

(56) References Cited

U.S. PATENT DOCUMENTS

| | | | | |
|---|---|---|---|---|
| 4,851,618 | A | 7/1989 | Amino et al. | |
| 5,717,429 | A * | 2/1998 | Coulon et al. | 345/168 |
| 6,664,486 | B2 * | 12/2003 | Yoon et al. | 200/5 A |
| 7,306,157 | B2 | 12/2007 | Barthelet et al. | |
| 2004/0031673 | A1 | 2/2004 | Levy | |
| 2007/0169520 | A1 | 7/2007 | Heo | |
| 2010/0025286 | A1 | 2/2010 | Mangaroo et al. | |

FOREIGN PATENT DOCUMENTS

| | | | |
|---|---|---|---|
| EP | 1876620 | A1 | 1/2008 |
| EP | 2012334 | A1 | 1/2009 |
| KR | 20070067431 | A | 6/2007 |

* cited by examiner

*Primary Examiner* — Renee Luebke
*Assistant Examiner* — Lheiren Mae A Caroc
(74) *Attorney, Agent, or Firm* — Hamilton, Brook, Smith & Reynolds, P.C.

(57) ABSTRACT

A key-board assembly (10) is described that has a key-mat and a keyboard PCB (3) aligned with respect to each other instead of first to a housing of an input device. First, such alignment is achieved by adding pins (6) to the key-mat that fit tightly in holes (5) of the PCB. Secondly the key-mat has hooks (14) that can be clicked around the PCB and/or ribs (4) around the edges/carve-outs of the PCB that hold to the PCB with tight tolerances.

9 Claims, 4 Drawing Sheets

MODULAR KEYBOARD ASSEMBLY

FIELD OF THE INVENTION

The invention relates to a mechanical design for a modular keyboard assembly. Such assembly typically includes 1) a key-mat with press buttons for facilitating and/or making an electrical contact on a keyboard PCB, and 2) a keyboard PCB. Such assembly is in particular useful for a keyboard in a remote control or in other portable devices having one or more keys or in a keyboard (useful e.g., for text entry).

BACKGROUND OF THE INVENTION

The U.S. Pat. No. 4,851,618 A discloses a computer keyboard in which a key holding frame is attached to a base plate comprising electrical circuits by a plurality of hooks and posts engaging with holes in the base plate.

The U.S. 2004/031673 A1 relates to a particular design of a keypad comprising both elevated and not-elevated regions which are separately evaluated by a particular algorithm. The keypad includes a keymat that is rigidly held at its perimeter in a stretched condition across a switch substrate.

The EP 1 876 620 A1 relates to a remote control in which several components are aligned to a common housing.

Due to current product and design requirements more and more devices require input key-mat with press buttons close to each other and close to the edge of an input device.

Parts of a portable device are typically aligned to the (top and/or bottom part of) housing of the device, e.g., by hooking to the housing. This housing typically comprises a plastic injected part with higher tolerances. The key-mat and housing need to be properly aligned for visual and functional requirements and this result e.g., in gaps which are a compromise between avoiding 'sticking' key-press/buttons and small optical gaps. Also, tolerances between the press buttons are high because they are aligned towards the housing and/or the key-mat is from a rubber material with inherent high tolerances.

For a small key-mat above mentioned hooking and aligning to top and/or bottom part is feasible. However for a bigger key-mat, such as in a remote control, the hooking and aligning is less feasible, e.g., due to plastic molding tolerances. Moreover no provision for a modular design of the key-mat is available.

SUMMARY OF THE INVENTION

There is a need to better align a key-mat to a keyboard PCB and thereby get smaller tolerances of the spacing between the press buttons.

It is therefore an object of the invention to provide a keyboard assembly where a key-mat and a keyboard PCB are tightly aligned with respect to each other.

This is realized according to claim 1 by providing alignment means enabling alignment of a key-mat comprising at least two key-mat strips to the PCB.

By providing alignment means, press buttons do not have to be limited in size (or can get bigger for a given size of a key board assembly) because less/no space needed between them and their surface can go all the way to the edge of the device. Robust design is provided as to prevent peeling-off of the keys (i.e. pulling out by nail or with the help of a tool). When using alignment means, tight tolerances, on parts other than the PCB, are not needed as to get even gaps between the buttons. Tight tolerances are e.g., especially challenging for standard plastic injection molded products such as typically used in handheld devices.

Another advantage of using alignment means lies in that a press button layout is less constrained by the selected tooling and (in so far applicable) related inserts, and thus allows more flexibility because it does need less optimization and dedication for specific button layouts.

Moreover using alignment means allows for a modular design by using different key-mat strips and, in so far applicable, intermediate top-parts that can be attached to the keyboard-PCB in an alternating fashion.

In the prior art the key-mat and the key-board PCB are aligned both independently to the housing of an input device. Directly aligning the key-mat and the keyboard PCB with respect to each other effects that a higher accuracy is achieved.

DETAILED DESCRIPTION OF EMBODIMENTS

Figure 1A:
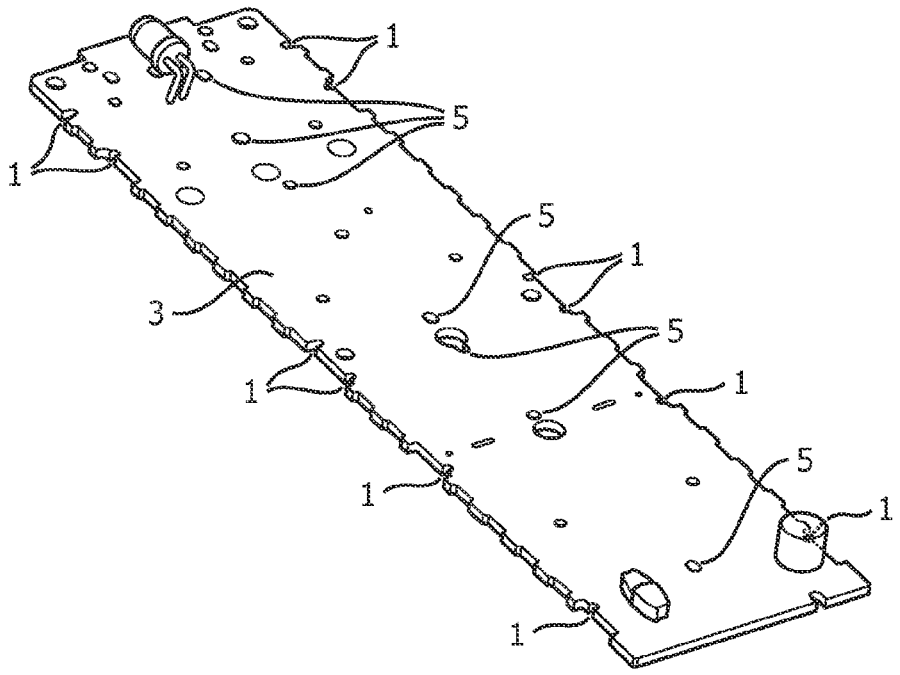
FIG. 1*a* Keyboard PCB showing an alignment rib position for an (intermediate) top-part.

FIG. 1*a* shows a keyboard PCB (3) showing alignment rib positions (1) that can be used for aligning (intermediate) top-parts to the keyboard PCB. Alignment rib positions comprise small carve outs (1) at the side of the keyboard PCB. Keyboard PCB also comprises holes (5) which can be used for aligning (intermediate) top-parts to the keyboard PCB.

Figure 1B:
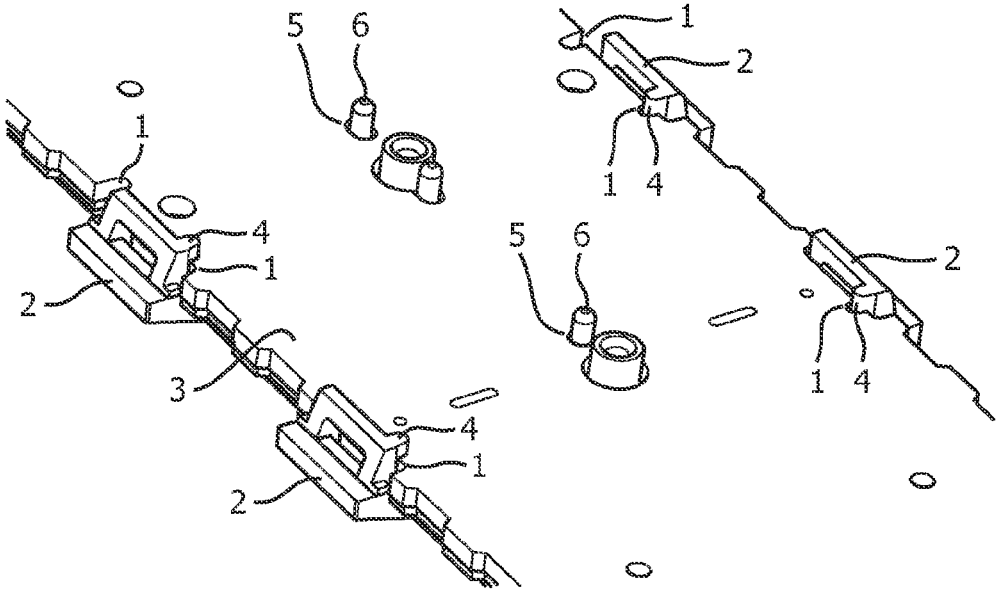
FIG. 1*b* Keyboard PCB with an (intermediate) top-part attached.

FIG. 1*b* shows (intermediate) top-parts (2) in position with respect to the keyboard PCB whereby ribs (4) of the (intermediate) top-parts fit tightly in small carve outs (1) at the side of the keyboard PCB (3). Thereby a good alignment of the (intermediate) top-part and the key-board PCB is achieved. The alignment with the ribs can also be used with a key-mat. In this exemplary drawing the top-parts are also kept in position using alignment position pins (6) through position holes (5) in keyboard PCB (3).

Figure 2A:
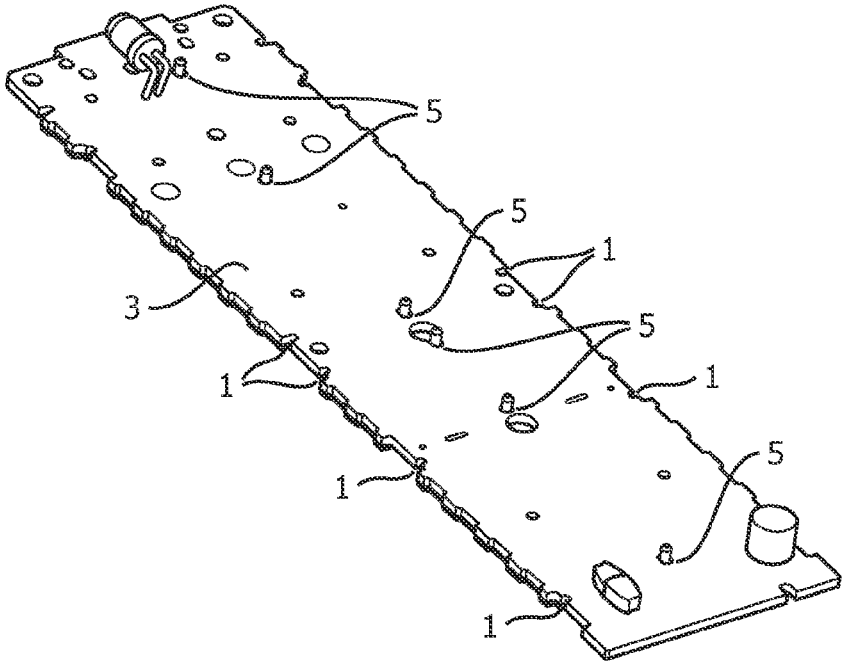
FIG. 2*a* Keyboard PCB showing an alignment pin positions for a key-mat (strip).

FIG. 2*a* shows a keyboard PCB (3) showing hole positions that can be used for aligning (intermediate) top-parts (2) and key-mat strips (7) to the keyboard PCB.

Figure 2B:
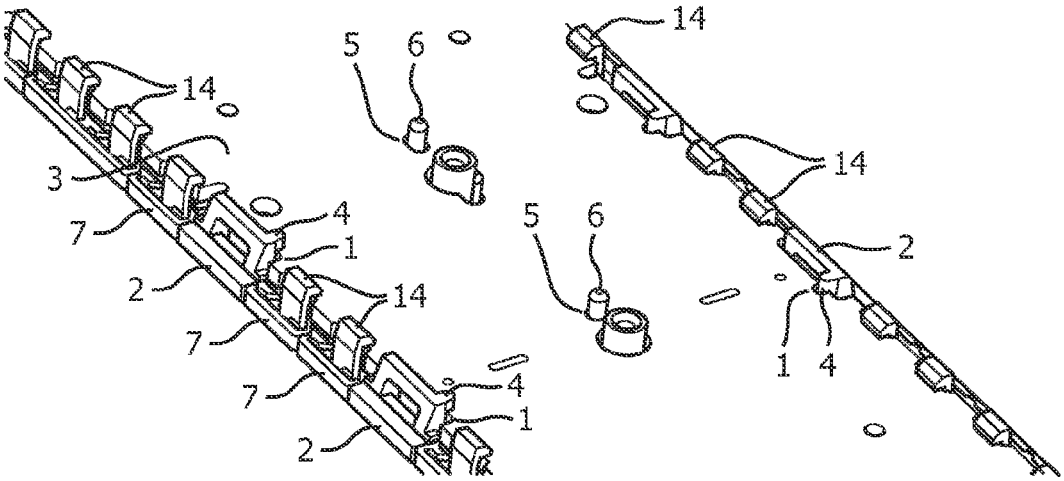
FIG. 2*b* Keyboard PCB with an (intermediate) top-part and a key-mat (strip) attached.

FIG. 2*b* shows key-mat strips (7) in position with respect to the keyboard PCB (3) whereby position pins (6) of a key-mat fit tightly in (relative small) position holes (5) of the keyboard PCB. Thereby a good alignment of the key-mat strips and the key-board PCB is achieved. The alignment with the pins/holes can also be used with a (another) (intermediate) top-part.

Figure 3:
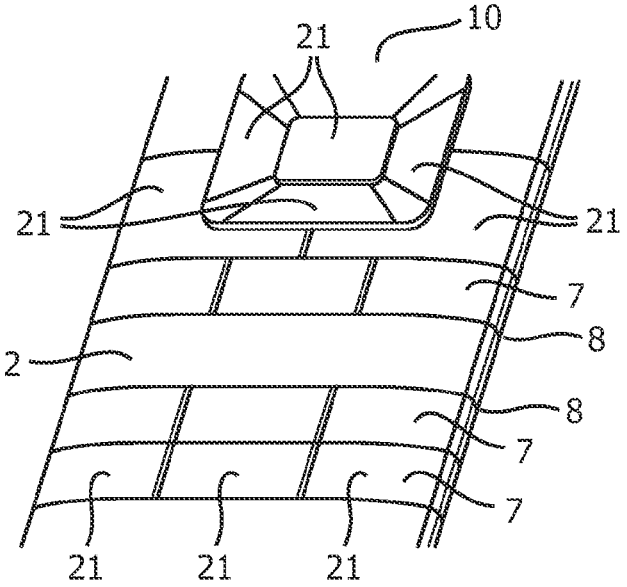
FIG. 3 showing an (intermediate) top-part and a key-mat (strips) mounted on a keyboard-PCB having even gaps between the parts.

FIG. 3 shows a top-view of a keyboard assembly (10) and in particular showing that a (tight) alignment at, e.g., position (8) has even gaps between various key-mat strips (7) and other (intermediate) top-parts (2) is achieved using the measures as shown in FIGS. 1 and 2. A key-mat strip may comprise one or more pres-buttons (e.g., three keys or press buttons, 21, are shown in the bottom key-mat strips of FIG. 3) concatenated in one strip, typically extending over the width of a portable input device. A multiple key-mat strips may be part a bigger key-mat strip, typically when positioned next to each other. However for tactile feedback to the user the key-mat strips may be not be made from one mould. Instead the key-mat strips may be connected or otherwise attached to a common (e.g., rubber) sheet positioned between the key-mat strips and the key-board PCB. An alignment pin or rib may be part of the common sheet instead or on top of the one(s) of the key-mat strip.

Figure 4:
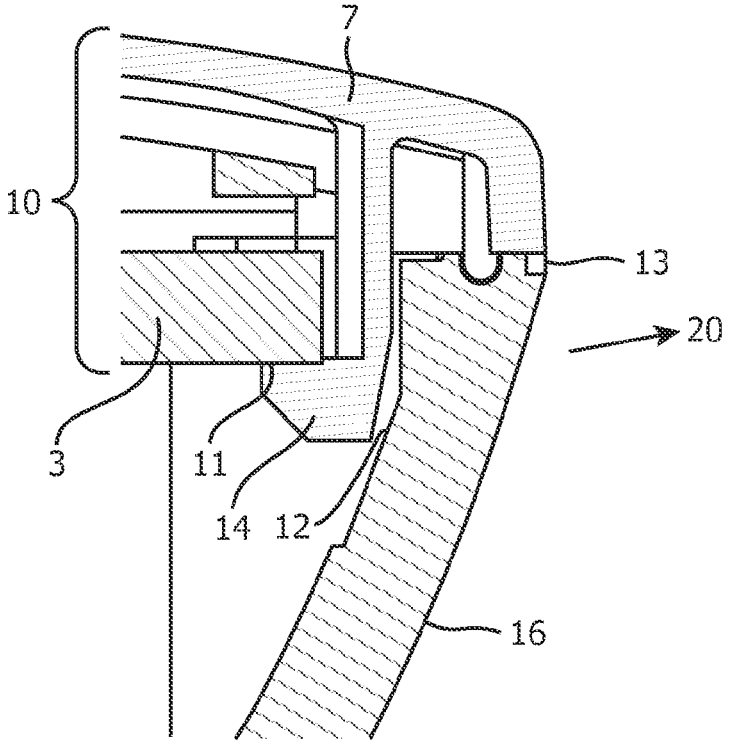
FIG. 4 Detailed drawing showing a hooking of a top-part or key-mat (strip) to a keyboard PCB and a recommended mounting position of a device housing.
Figure 5A:
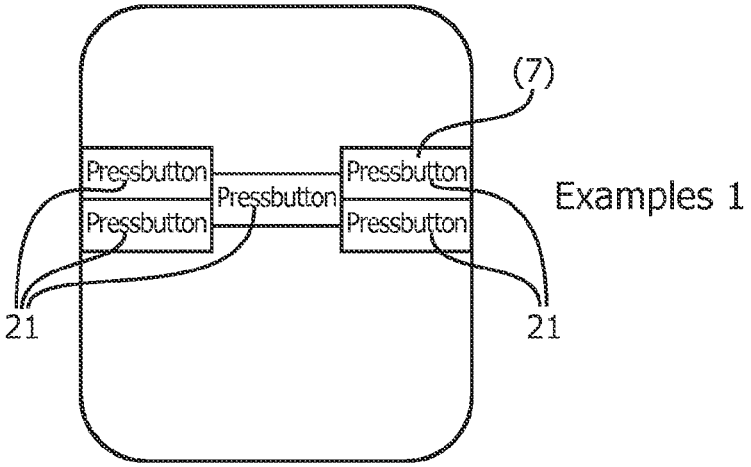
FIG. 5-*a*~*d* Various possible configurations of a key-mat (strips) and combinations of key-mat strips.
Figure 5B:
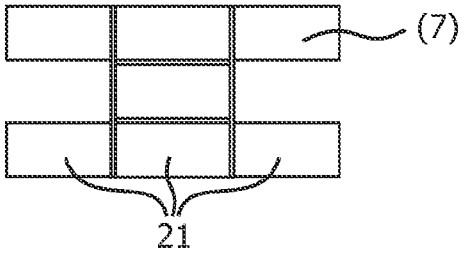
Figure 5C:
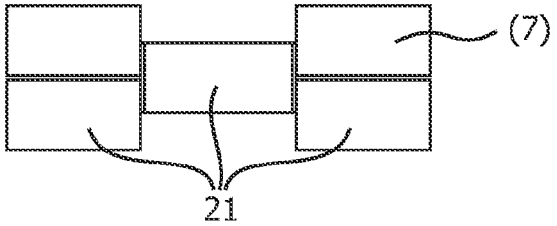
Figure 5D:
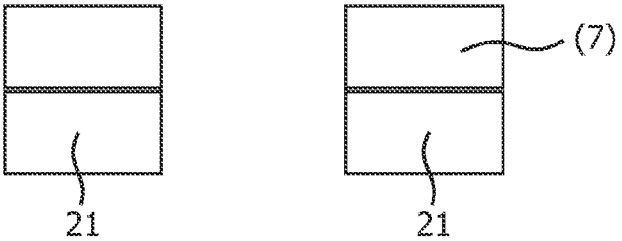

FIG. 4 shows a transversal cut view of a side of a portable device (20) comprising a keyboard assembly (10) and a bottom part (16). It shows a detailed mechanical drawing of the hooking between a key-mat strip (7) and the key-board PCB (3). Key-mat strip (7) comprises hook (14) that hooks at (11) to keyboard PCB (3). When a user would pull at position (13) (for example by using a finger-nail) the movement of the key-mat strip (7) will be stopped by the hook position (11). Bottom part (16) (e.g., a housing) will prevent at (12) any substantial side movement of the hook (14). Hook (14) thereby keeps in place with respect to the keyboard PCB (3) and the bottom part (16).

FIG. 5 shows various examples of possible configurations of key-mat strips (7). Key-mat strips can be combined into a unit. As can be seen from FIG. 5 it allows one or more press buttons or keys (21) to be out of a straight line.

In one embodiment the keyboard assembly (10) has alignment means that comprises at least one of:

a first alignment pin (6) fitting in a corresponding hole (5) in a keyboard PCB (3); and a first alignment rib (4) locking in a corresponding carve-out (10) at a side of the keyboard PCB.

In another embodiment the keyboard assembly has a key-mat strip (7) that comprises a hook (14) for locking the key-mat strip to a bottom edge of the keyboard PCB. The hook (14) may also comprise a rib (e.g., at the bottom part of the hook) as to help locking it and prevent side movement of the hook (14).

In yet another embodiment the keyboard assembly the key-mat comprises a strip of multiple connected key-mat strips that are fully extending over at least one direction of the PCB.

In yet a further embodiment the keyboard assembly comprising at least two key-mat strips positioned either next to each other (see e.g., bottom two strips 7 in FIG. 3); or spaced using an aligned top-part (see e.g., the two strips 7 between the top-part 2 in FIG. 3).

A further embodiment has a key-mat strip that does not extend over the full width of the device (e.g., in FIG. 5). Moreover, a strip may have a complex shape including e.g., more than one row of keys and even change in number of keys and/or height within the key-mat strip (see, e.g., FIG. 5).

In another keyboard assembly embodiment a top-part (2) is aligned to the keyboard PCB (3) using at least one of a second alignment pin (6) fitting in a corresponding hole (5) in the keyboard PCB; and a second alignment rib (4) locking in a corresponding carve-out (1) at a side of the PCB.

In between various key-mat strips a (key-divide) material may be placed as to improve tactile dividing of (key-press) buttons. For instance, the user will get an improved feeling between the various buttons. This material may be a part of one of the key-mat strips or may be a separate (e.g., rubber) dividing material.

In one embodiment the dividing material extends in a common sheet that lies in between key-mat strips and the keyboard PCB. The key-mat strips may be attached or otherwise connected to the common sheet, effectively forming a key-mat that comprises key-mat strips and the common sheet (similar to the common sheet described earlier for FIG. 3). An alignment pin or rib may be part of the common sheet instead or on top of the one(s) of the key-mat strip.

The keyboard assembly according one of the previous embodiments can be made by using a key-mat that comprises a plastic or a rubber molded part.

The keyboard assembly embodiments may have a PCB that comprises a carbon or other contact area for making an electrical contact when the key-part is actuated.

The invention works with several types of keys to be actuated by a user. For instance the keyboard assembly may have a PCB that comprises a metal dome key that can be actuated by the key-part.

In another embodiment, the keyboard PCB may be replaced by a flexible foil in combination with contact areas that allows different shapes of a handheld device in combination with a part that has tight tolerances and that takes over the function of the keyboard PCB.

The above embodiments can be used in combination with existing button technologies and solutions.

The previously described embodiments of the keyboard assembly are in particular useful for in a handheld device such as a remote control, a PDA, a cellular telephone.

It should be noted that the above-mentioned embodiments illustrate rather than limit the invention, and that those skilled in the art will be able to design many alternative embodiments without departing from the scope of the appended claims. The mere fact that certain measures are recited in mutually different dependent claims does not indicate that a combination of these measures cannot be used to advantage. The word 'comprising' does not exclude the presence of other elements or steps than those listed, and the word 'a' or 'an' preceding an element does not exclude the presence of a plurality of such elements. Any reference signs do not limit the scope of the claims.

For instance, the invention may be implemented for key-mats for use with both with hard and soft key press buttons and corresponding materials. Materials that can be used to make the key-mat include rubber, plastic and metal in combination with all types of finishing and printing and colors (including colorless). The key-mats may also include a back-lighting (e.g., by means of LEDs on the keyboard-PCB and by using an at least partly translucent key-mat) or may comprise themselves a light-source. The key-mats may also be combined with (proximity) sensing that may, e.g., be used for improved user feedback.

The invention claimed is:

1. A keyboard assembly comprising:

a key-mat comprising at least two separate key-mat strips; and a keyboard PCB;

wherein each respective one of the at least two separate key-mat strips comprises one or more respective ones of a plurality of press buttons, and the key-mat strips comprise alignment to align with the keyboard PCB and that at least one of the key-mat strips comprises a hook for locking the key-mat strip to a bottom edge of the keyboard PCB and the alignment means comprises at least one of:

a first alignment pin fitting in a corresponding hole in the keyboard PCB; and a first alignment rib locking in a corresponding carve-out at a side of the keyboard PCB.

2. The keyboard assembly according to claim 1, wherein the key-mat further comprises a multiple, connected, key-mat strip that is fully extending over at least one direction of the keyboard PCB.

3. The keyboard assembly according to claim 1, further comprising at least two key-mat strips positioned either next to each other; of spaced apart from each other using an aligned intermediate top-part.

4. The keyboard assembly according to claim 3, wherein the plurality of press buttons, form a spatial configuration with at least two rows or at least two columns;

a multiple of key-mat strips are combined into a unit having at least a first specific one of the plurality of press buttons, a second specific one of the plurality of press buttons and a third specific one of the plurality of press buttons;

the first specific press button and the second specific press button are arranged in a first one of the rows, or in a first one of the columns;

if the first specific press button and the second specific press button are arranged in the first one of the rows, then the third specific press button is arranged in the second one of the rows; and if the first specific press button and the second specific press button are arranged in the first one of the columns, then the third specific press button is arranged in the second one of the columns.

5. The keyboard assembly according to claim 3, wherein the intermediate top-part is aligned to the keyboard PCB using at least one of second alignment pin configured to fit in a corresponding alignment hole in the keyboard PCB; and a second alignment rib configured to lock in a corresponding alignment carve-out at a side edge of the keyboard PCB.

6. The keyboard assembly according to claim 1, wherein the key-mats comprise a plastic or a rubber molded part.

7. The keyboard assembly according to claim 1, wherein the keyboard PCB comprises a carbon area for making an electrical contact when a press-button is actuated.

8. The keyboard assembly according to claim 1, wherein the keyboard PCB comprises a metal dome key that can be actuated when a press-button is actuated.

9. A handheld device comprising the keyboard assembly according claim 1.

* * * * *

UNITED STATES PATENT AND TRADEMARK OFFICE

CERTIFICATE OF CORRECTION

PATENT NO. : 9,281,141 B2
APPLICATION NO. : 13/808408
DATED : March 8, 2016
INVENTOR(S) : Kurt Rochlitz et al.

It is certified that error appears in the above-identified patent and that said Letters Patent is hereby corrected as shown below:

In the Claims

Column 5, Claim 3, Line 7: Delete "of" and insert -- or --

Signed and Sealed this
Twenty-fourth Day of May, 2016

Michelle K. Lee

Michelle K. Lee
*Director of the United States Patent and Trademark Office*